United States Patent [19]

Creek

[11] Patent Number: 5,033,135

[45] Date of Patent: Jul. 23, 1991

[54] DISPOSABLE SLEEPING BAG

[76] Inventor: Wilson Creek, 717 Southwest Second St., Ontario, Oreg. 97914

[21] Appl. No.: 535,122

[22] Filed: Jun. 11, 1990

[51] Int. Cl.[5] ..... A47G 9/08

[52] U.S. Cl. ..... 5/413; 2/69.5

[58] Field of Search ..... 5/420, 413, 486, 502; 2/69.5

[56] References Cited

U.S. PATENT DOCUMENTS

| | | | |
|---|---|---|---|
| 1,699,002 | 1/1929 | Leibold | 5/413 |
| 2,625,695 | 1/1953 | Nicholson | 5/413 X |
| 3,460,170 | 8/1969 | Ozier | 5/413 X |
| 3,636,566 | 1/1972 | Sutherland | 2/69.5 |
| 3,739,399 | 6/1973 | Sheahon | 2/69.5 |
| 4,547,906 | 10/1985 | Nishida et al. | 5/413 X |
| 4,549,323 | 10/1985 | Brockhaus | 5/502 |
| 4,550,046 | 10/1985 | Miller | 428/116 |
| 4,658,452 | 4/1987 | Brockhaus | 5/420 |
| 4,862,533 | 9/1989 | Adams, III | 5/413 |
| 4,910,055 | 3/1990 | Wigutow | 2/69.5 X |

*Primary Examiner*—Michael F. Trettel

*Attorney, Agent, or Firm*—Frank J. Dykas; Craig M. Korfanta

[57] ABSTRACT

A disposable sleeping bag (10) is disclosed which is manufactured using a spunbonded olefin material in place of the standard paper or cloth outer cover and inner lining. A layer of polyester batting (16) is used as the primary insulation material while a second layer of polyester batting (15) acts as a secondary cushion material over a layer of bubble packing (13) acting as the primary cushioning material in lower cushion (11).

2 Claims, 6 Drawing Sheets

DISPOSABLE SLEEPING BAG

BACKGROUND OF THE INVENTION

1. Technical Field

This invention generally relates to sleeping bags and in particular to a lightweight disposable and well cushioned sleeping bag for use by fire fighters, disaster relief crews, military personnel and the like.

2. Background Art

There are numerous occasions when large groups of people must be mobilized and relocated to a temporary camp or location for a number of days, weeks or even months. The logistical duties associated with a large scale mobilization of personnel are many and include providing each crew member with a warm and comfortable place to sleep. The logistics technician is faced with the task of balancing the crew's comfort level against the cost and bulk of the support equipment provided. As a result, lightweight disposable sleeping bags have been developed as a partial solution to the problem of where, and what in, a crew member is suppose to sleep. The United States government purchases tens of thousands of these disposable sleeping bags a year to outfit various government agencies.

The prior art solution has a sleeping bag manufactured from paper and filled with a hollow polyester fiber batting. There are several disadvantages to this type of bag, including both an insufficient amount of padding between the ground and the sleeper, making the bag uncomfortable and the propensity of the sleeping bag to absorb ground moisture.

Other prior art sleeping bags are taught in Ozier, U.S. Pat. No. 3,460,170 and Nicholson, U.S. Pat. No. 2,625,695. Ozier teaches a disposable sleeping bag which is manufactured from paper and has a plastic or other water impervious material bonded to the outside surface. Nicholson teaches a paper sleeping bag made from crinkle or crepe paper to add an element of elasticity. Obviously, since both of these bags are made from paper, they are prone to tearing and multilation.

What is needed is a disposable lightweight sleeping bag which is not susceptible to absorbing moisture from the ground and which provides additional padding and insulation from the group to the user. Accordingly, objects of the present invention include providing a lightweight disposable sleeping bag which is cost efficient, comfortable, warm, and will not absorb ground moisture.

DISCLOSURE OF INVENTION

These and other objects are accomplished by constructing a sleeping bag from lightweight and inexpensive materials including polyester batting, a layer of bubble packing and TYVEK, a synthetic paper-like cloth. The lower cushion of the sleeping bag, i.e., the cushion on which a person sleeps, is constructed using a first layer of bubble packing and a second layer of polyester batting. The bubble packing is similar to that used in shipping for protecting fragile items. The bubble pad has a plurality of protruding sealed air bubbles supported on a plastic sheet at regular intervals. The plastic sheet acts both as an insulator and as a vapor barrier. The polyester batting layer, which is placed on top of the bubble pack layer, acts as an insulator and as a force distribution layer whereby point loads are distributed more evenly to prevent the individual bubbles from being popped while a person is climbing in and out of the sleeping bag. The upper cover of the sleeping bag includes a layer of polyester batting which acts as an insulator. Both the lower cushion and the upper cover are encased in TYVEK, which is manufactured by DuPont and is a paper-like product which is very strong, water resistant and air permeable.

Additional provisions include a weather flap, weather flap closure means, roll tie straps for rolling up the sleeping bag and hood tie straps which act to form a hood around the head of a sleeper. The sleeping bag can be manufactured according to standard textile fabrication techniques which are well known in the art.

BEST MODE FOR CARRYING OUT INVENTION

Referring now to the figures, the construction and configuration of disposable sleeping bag 10 is illustrated. In general, the basic principles of textile construction apply with the exception of the materials used. Rather than using a traditional fabric cloth to construct the sleeping bag cover and sleeping bag liner, a specialized synthetic paper-like cloth is utilized, known as spunbonded olefin. Cover 17, actually outer spunbonded olefin panel 18 and inner spunbonded olefin panel 19, are made from a durable, water resistant and air permeable synthetic paperlike product sold under the name TYVEK by DuPont. This material is manufactured from high-density polyethylene fibers which are first spun and subsequently bonded together using heat and pressure. The result is an extremely lightweight product, about half the weight of a comparable thickness paper product, and at the same time is less expensive, water resistant and more durable.

Figure 1A:
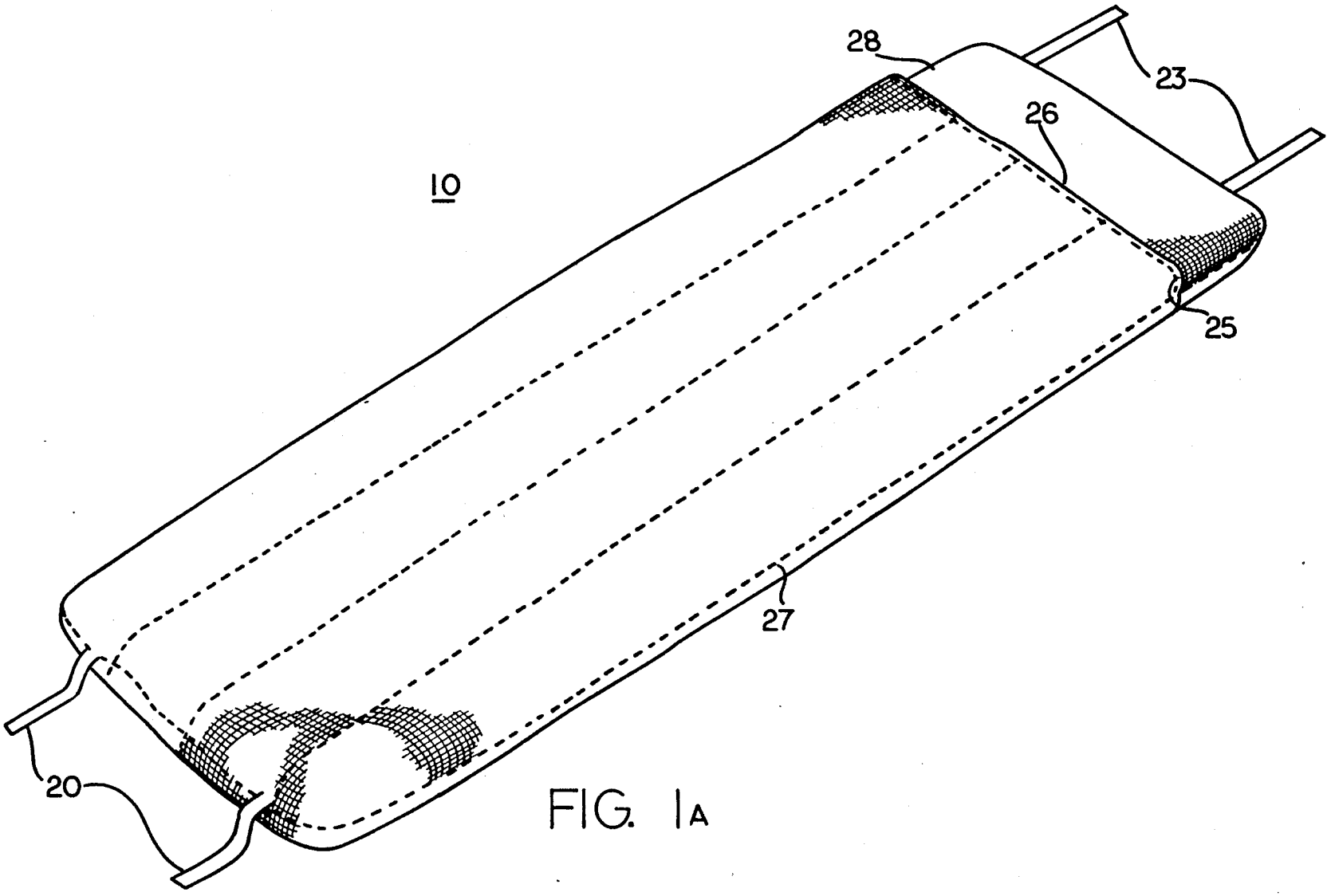
FIG. 1*a* is a three-quarter elevation view of the disposable sleeping bag from a bottom end.
Figure 1B:
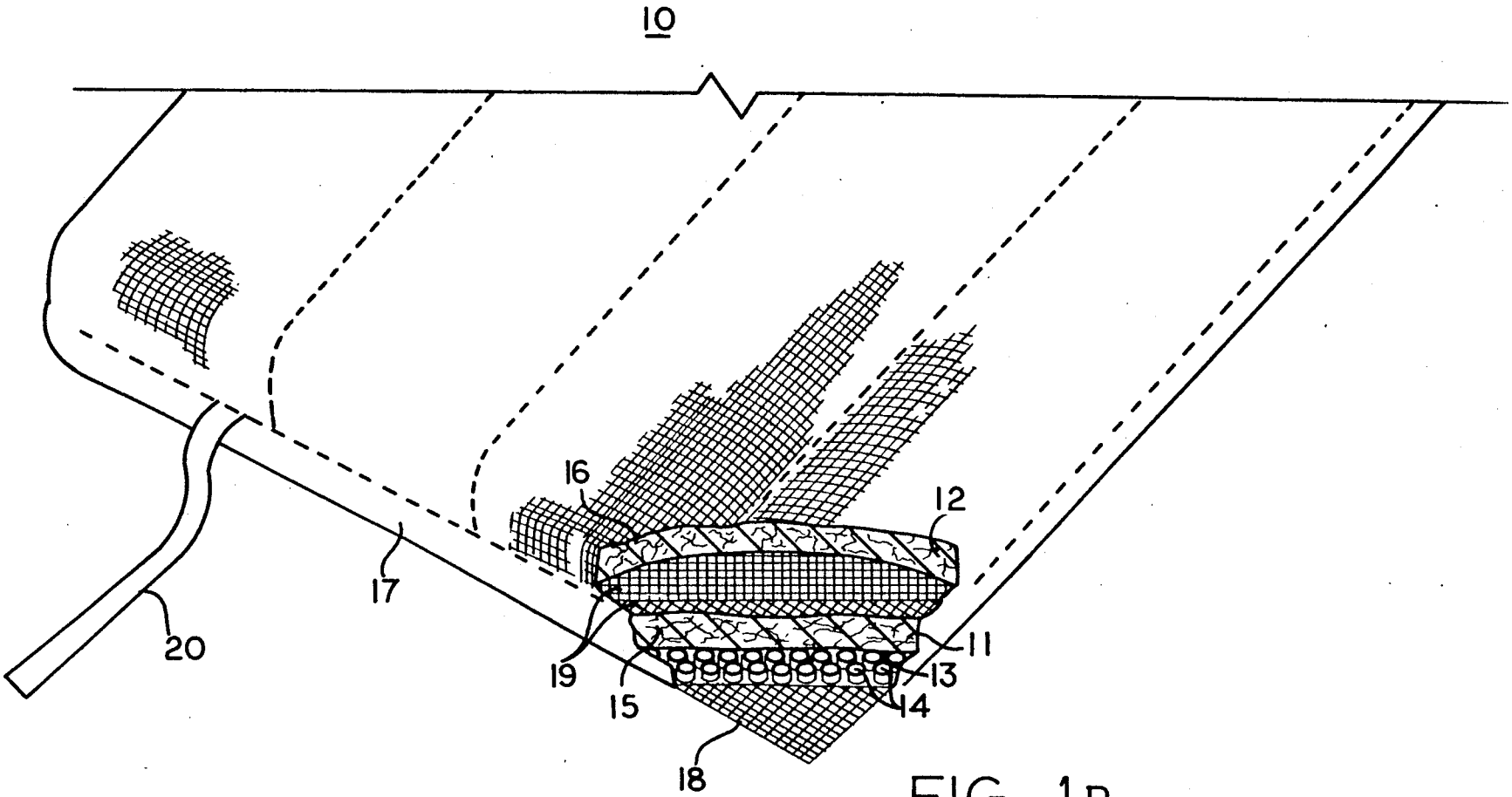
FIG. 1*b* is an exploded partial cutaway view of the bottom end of the disposable sleeping bag showing the inner layer.
Figure 2:
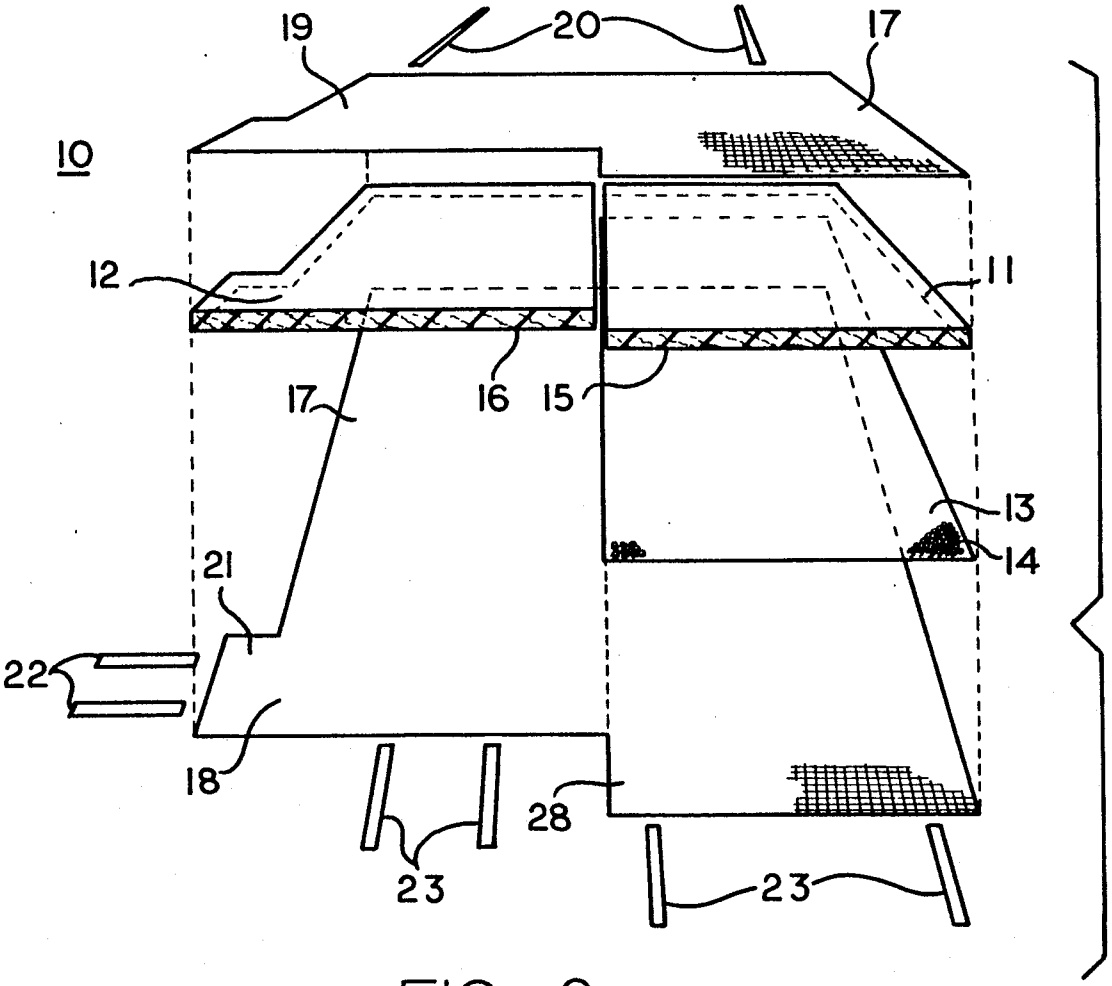
FIG. 2 is an assembly drawing showing the construction of the disposable sleeping bag.

In fabricating disposable sleeping bag 10 a first outer spunbonded olefin panel 18, hereinafter referred to as outer panel 18, is attached to an inner spunbonded olefin panel 19, hereinafter referred to as inner panel 19, along main seam 24 using a suitable stitching or other fastener. Outer panel 18 and inner panel 19 are first joined along top opening seam 25 via stitching or other suitable attachment means. The resulting construction is then turned inside out to produce a hidden seam along opening 26 of disposable sleeping bag 10. Outer panel 18 and inner panel 19 are then joined along main seam 24 to produce the right and left halves of the construction shown in FIG. 2. These right and left halves will subsequently become lower cushion 11 and upper cover 12. A first bubble pack layer 13 is then inserted between outer panel 18 and inner panel 19 on the right side of main seam 24, as is shown in FIG. 2, with protruding sealed air bubbles facing inner panel 19. This disposes the smooth surface of bubble pack layer 13 directly against the inside surface of outer panel 18 to act as both a vapor barrier and a protective layer to prevent objects from breaking sealed air bubbles 14. A second layer of polyester batting 15 is placed between inner panel 19 and bubble pack layer 13. Second polyester batting layer 15 acts both as an insulator and as a force distribution layer which acts to more evenly distribute the point loads associated with someone climbing in and out of the sleeping bag. This second layer helps prevent the individual air bubbles 14 from being popped by point loads.

An upper layer of polyester batting 16 is then placed between outer panel 18 and inner panel 19 on the left side of main seam 24. The left half is then folded over onto the right half along main seam 24 and the two halves are joined together along perimeter seam 27. The entire bag is then turned inside out to produce a hidden perimeter seam.

Figure 3:
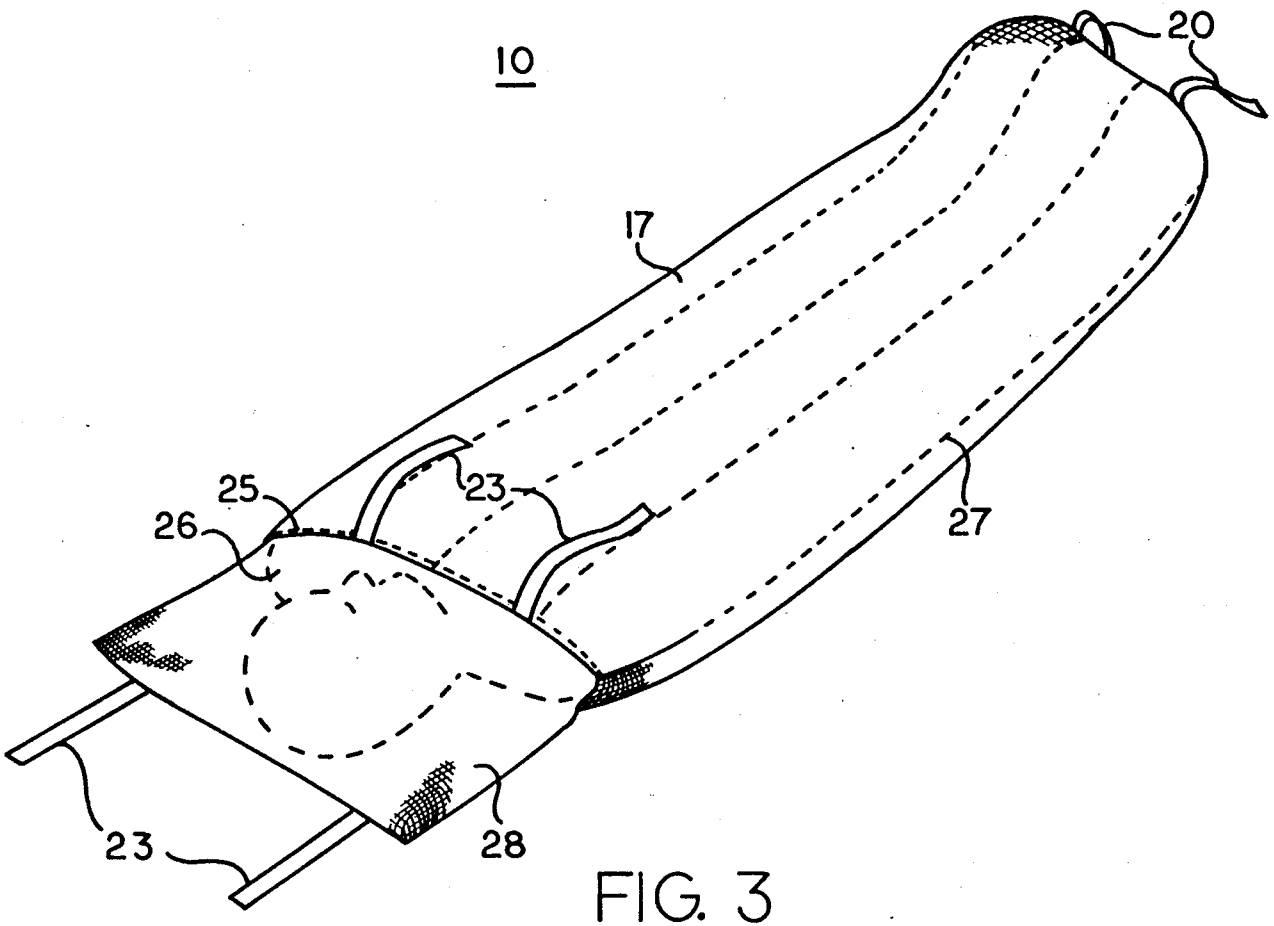
FIG. 3 is a three-quarter elevation view from a second perspective.
Figure 4:
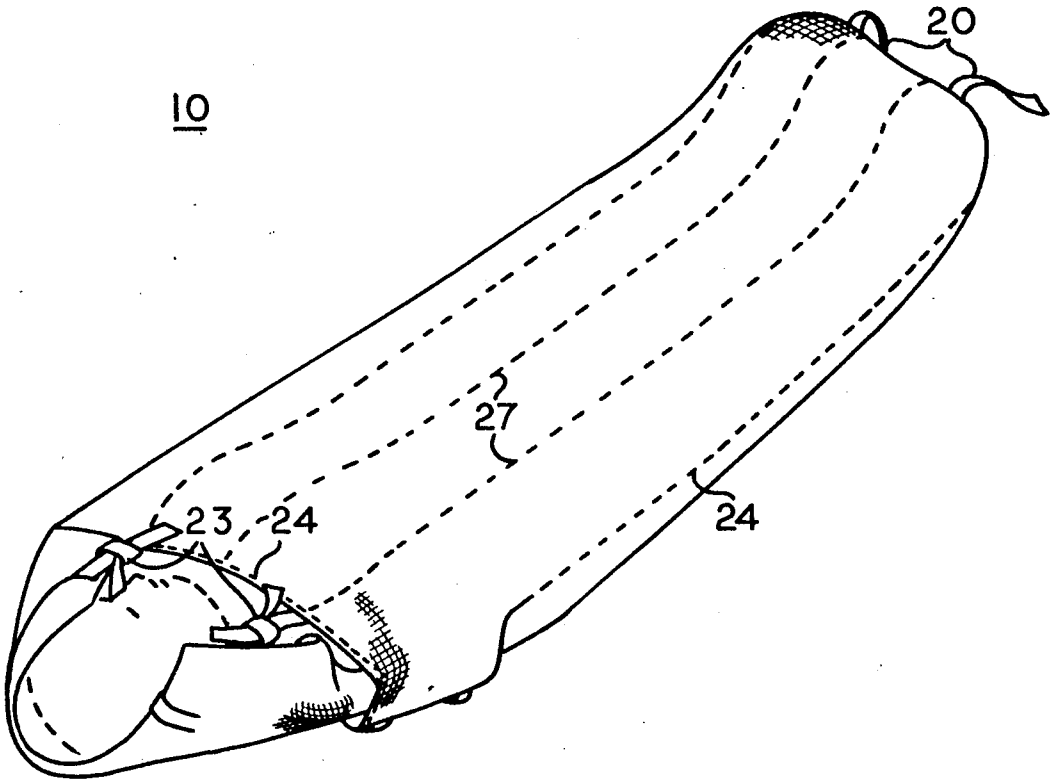
FIG. 4 is a three-quarter elevation view from the same perspective with the weather flap out and hood straps tied to form a hood around the head of the user.
Figure 5:
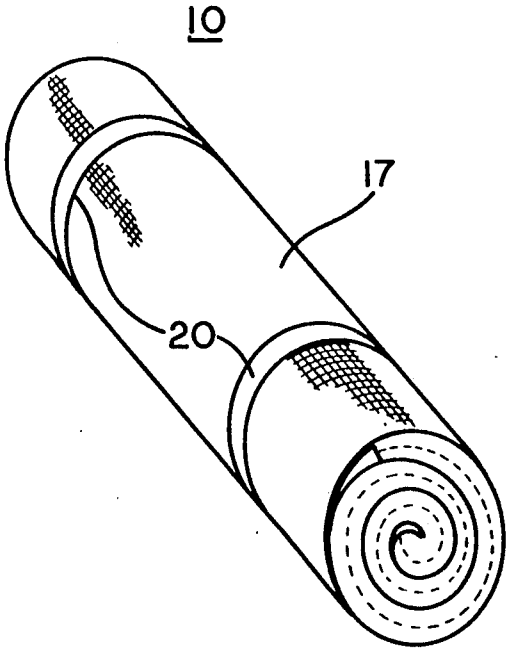
FIG. 5 is a three-quarter view of the disposable sleeping bag in a rolled up configuration.

Tie straps 20, weather flap tie straps 22 and hood tie straps 23 can either be attached externally or sewn into the seams during construction. Tie straps 20 are advantageously attached to the base or foot of sleeping bag 10 to facilitates tying the bag in the rolled configuration shown in FIG. 5. Weather flap tie straps 22 and hood tie straps 23 are positioned as shown in FIGS. 3 and 4 to permit bag opening 26 to be closed around the user as is shown in FIG. 4.

Because bag is constructed from spunbonded olefin, polyester batting and a plastic bubble pack layer, the bag can be laundered and reused, thereby extending its useful life. Additionally, because spunbonded olefin is water vapor permeable, moisture from laundering and perspiration will evaporate, preventing mildew from forming in the sleeping bag and increasing the comfort level of the sleeping environment. In use, disposable sleeping bag 10 functions identically in most respects to that of a standard sleeping bag with the exception of it being much lighter and less expensive. This permits disposal of the sleeping bag which is more cost effective than transporting, storing and maintaining a large number of standard sleeping bags.

While there is shown and described the present preferred embodiment of the invention, it is to be distinctly understood that this invention is not limited thereto but may be variously embodied to practice within the scope of the following claims.

I claim:

1. A disposable sleeping bag which comprises:

a lower cushion having a plurality of layers encased within a spunbonded olefin covering;

said plurality of layers including a first vapor impervious bubble pack layer having a plurality of air filled bubbles thereon and a second insulation and force distribution layer;

a vapor permeable upper cover having at least one insulating layer encased within a spunbonded olefin covering; and said upper cover being peripherally attached to said lower cushion to form a pocket between said lower cushion and said upper cover to be occupied while sleeping.

2. The disposable sleeping bag of claim 1 wherein said second insulation and force distribution layer and said insulating layer are comprised of a polyester fiber batting.

* * * * *